US005918551A

United States Patent [19]

Liu

[11] Patent Number: 5,918,551

[45] Date of Patent: Jul. 6, 1999

[54] TRESTLE STAGE

[76] Inventor: Ching Rong Liu, No. 10, Sung-Chiang N. Rd., Chung-Li City, Taiwan

[21] Appl. No.: 09/018,560

[22] Filed: Feb. 4, 1998

[51] Int. Cl.[6] ..... B65D 19/00

[52] U.S. Cl. ..... 108/55.1; 108/53.1; 108/55.3; 108/91; 108/901

[58] Field of Search ..... 108/51.3, 53.1, 108/55.1, 55.3, 56.1, 56.3, 57.29, 91, 186, 901, 902; 206/386, 600, 595; 248/346.01, 346.02; 211/188, 194

[56] References Cited

U.S. PATENT DOCUMENTS

| | | | |
|---|---|---|---|
| 3,994,241 | 11/1976 | Evans | 108/901 X |
| 4,062,300 | 12/1977 | Real | 108/55.3 X |
| 5,125,348 | 6/1992 | Horwitz | 108/186 X |
| 5,197,396 | 3/1993 | Breezer et al. | 108/901 X |

FOREIGN PATENT DOCUMENTS

| | | | |
|---|---|---|---|
| 487147 | 5/1992 | European Pat. Off. | 108/901 |
| 1417523 | 12/1975 | United Kingdom | 108/55.1 |

*Primary Examiner*—Peter M. Cuomo
*Assistant Examiner*—Janet M. Wilkens
*Attorney, Agent, or Firm*—Bacon & Thomas, PLLC

[57] ABSTRACT

A trestle stage comprises a plyboard and a plurality of supporting beams wherein the plyboard is provided with an embedding groove on each corner thereof and a through hole on the position of each embedding groove, and each supporting beam has embedding plates on both its ends to engage with the embedding grooves and embedding piece corresponding to the respective through hole, such that two plyboard can be kept with constant separation by the supporting beams therebetween and the inventory therein can be stored in layer-fashion without deformation.

5 Claims, 5 Drawing Sheets

TRESTLE STAGE

FIELD OF THE INVENTION

The present utility relates to a trestle stage which can be used to store inventory layer by layer, and prevent the stored inventory from being deformed by pressure.

BACKGROUND OF THE INVENTION

A trestle stage is usually employed to sustain the inventory to be stored and can be lifted to suitable position by a forklift for convenience of storing and conveying inventory.

As shown in FIG. 1, the conventional trestle stage 10 is formed by wood or injection plastic with a flat-plane shape, and has a plurality of insertion holes 11 on lateral side thereof for the insertion of the forklift.

As shown in FIG. 2, during the application of the conventional trestle stage 10, the inventory to be stored is placed on the conventional trestle stage 10 firstly. Afterward, another trestle stage loaded with inventory 20 is placed upon the underlying trestle stage with the help of a forklift to achieve the storage of inventory and benefit the conveying work if necessary.

The conventional trestle stage 10 is preferably applicable to those inventories with rectangular shape and enough strength to pile them up with convenience and prevent them from damage. However, for inventories with irregular shape or deficient strength, the conventional trestle stage is not applicable in which the inventories of irregular shape supported by the conventional trestle stage are liable to slide or fall to damage Because it is hard to sustain a uniform separation between the upper and lower layer of trestle stage, the loading is uneven.

Above problem can be solved if the trestle stage can be such constructed that a constant separation can be kept therebetween to sustain the gravity. However, the trestle stage with such structure is not available yet.

SUMMARY OF THE INVENTION

It is the object of the present invention to provide a trestle stage comprises a plyboard and a plurality of supporting beams wherein the plyboard is provided with an embedding groove on each corner thereof and a through hole on the position of each embedding groove, and each supporting beam has embedding plates on both its ends to engage with the embedding grooves and embedding piece corresponding to the respective through hole, such that two or more plyboard can be kept with constant separation by the supporting beams therebetween and the inventory therein can be stored in layer-fashion without deformation due to squashing.

It is another object of the present invention to provide a trestle stage wherein a mesh can be arranged between the supporting beams such that the trestle stage can function as a basket for storing article with smaller volume.

BRIEF DESCRIPTION OF THE DRAWINGS

In order to better understand the present invention, reference should be made to the following detailed description taken in junction with the accompanying drawings wherein.

DETAIL DESCRIPTION OF THE PREFERRED EMBODIMENT

Figure 1:
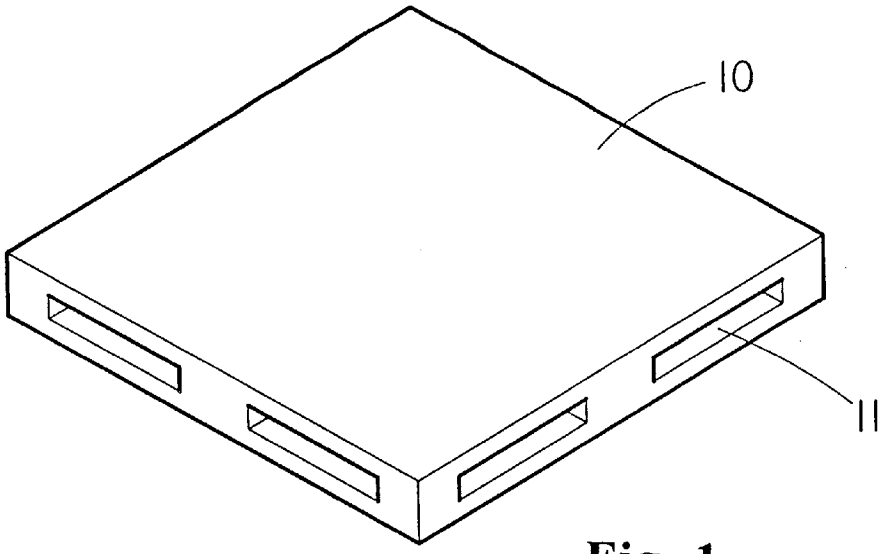
Fig. 1 PRIOR ART
FIG. 1 shows the perspective view of the conventional trestle stage.
Figure 2:
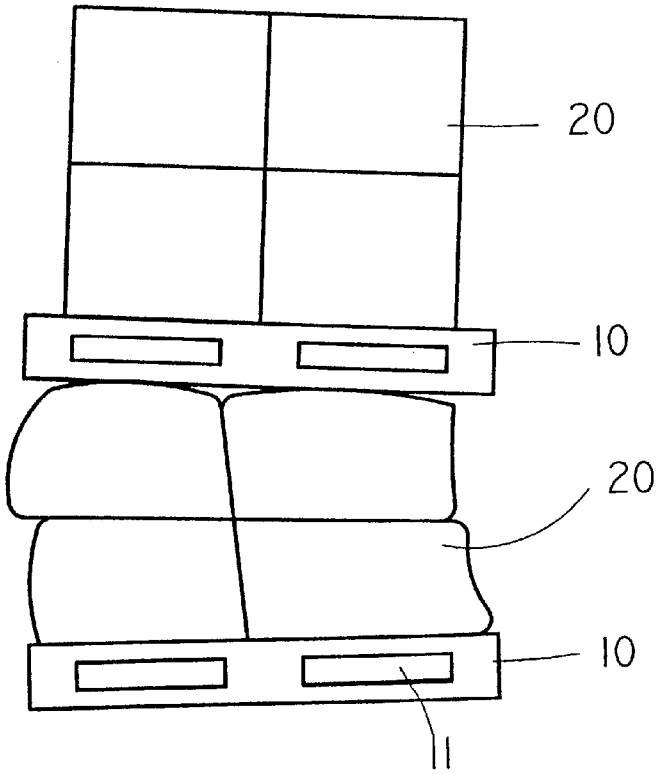
Fig. 2 PRIOR ART
FIG. 2 shows the situation in which the inventories are stored by the conventional trestle stage.
Figure 3:
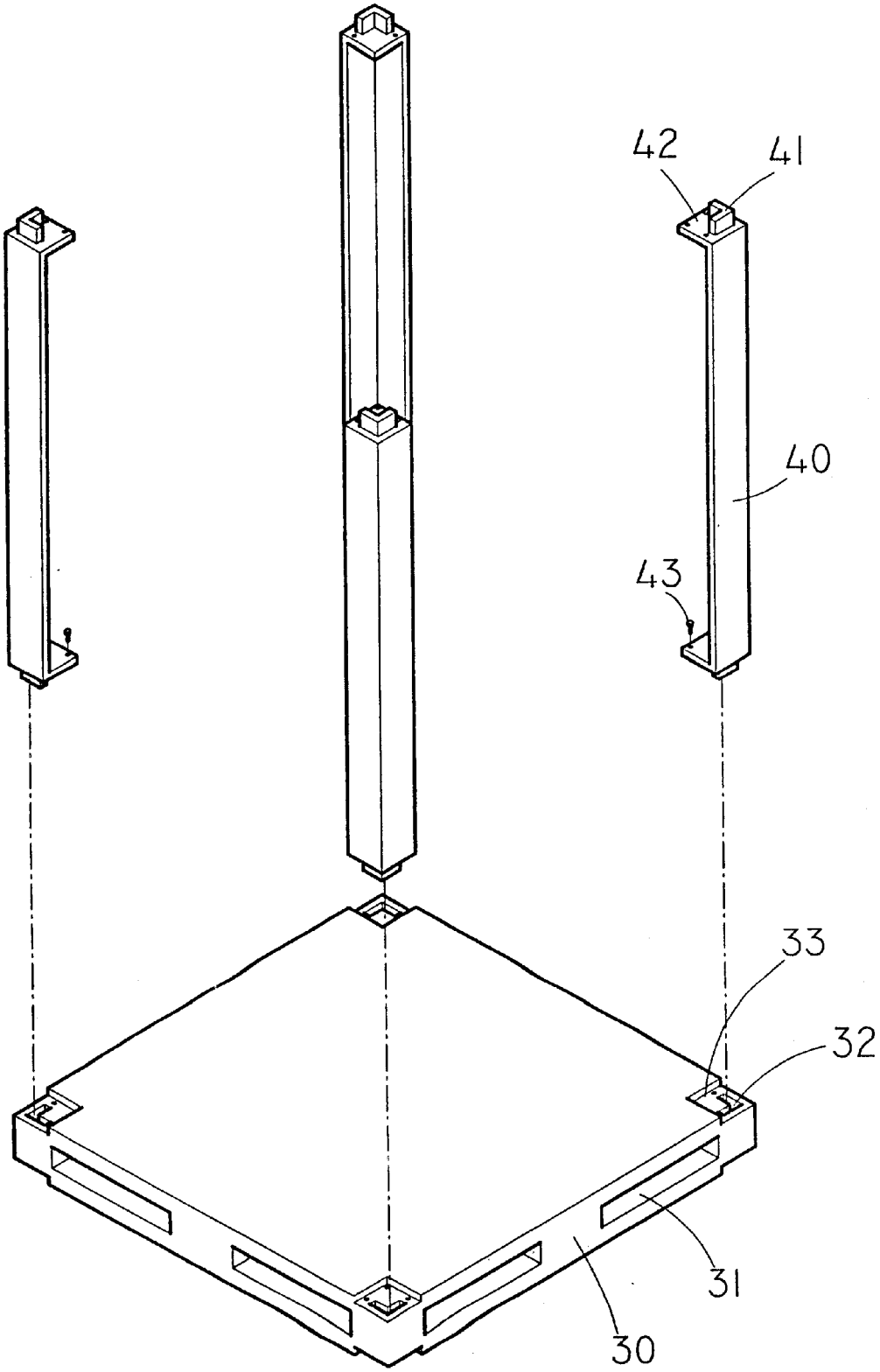
FIG. 3 is the exploded view of the trestle stage according to the present invention.

As shown in FIG. 3, the trestle stage according to the present invention comprises a rectangular-shape-plyboard 30 and a plurality of supporting beams 40, wherein:

the plyboard 30 is provided with at least two insertion holes 31 on each lateral side thereof, embedding grooves 33 on the four corners thereof and a through hole 32 formed in a bottom wall of each embedding groove 33 and extending through the plyboard 30.

each supporting beam 40 has an embedding piece 41 corresponding to the through holes 32 on each of its end, and an embedding plate 42 corresponding to the embedding grooves 33, with the embedding piece extending outwardly of the embedding plate 42.

Figure 4:
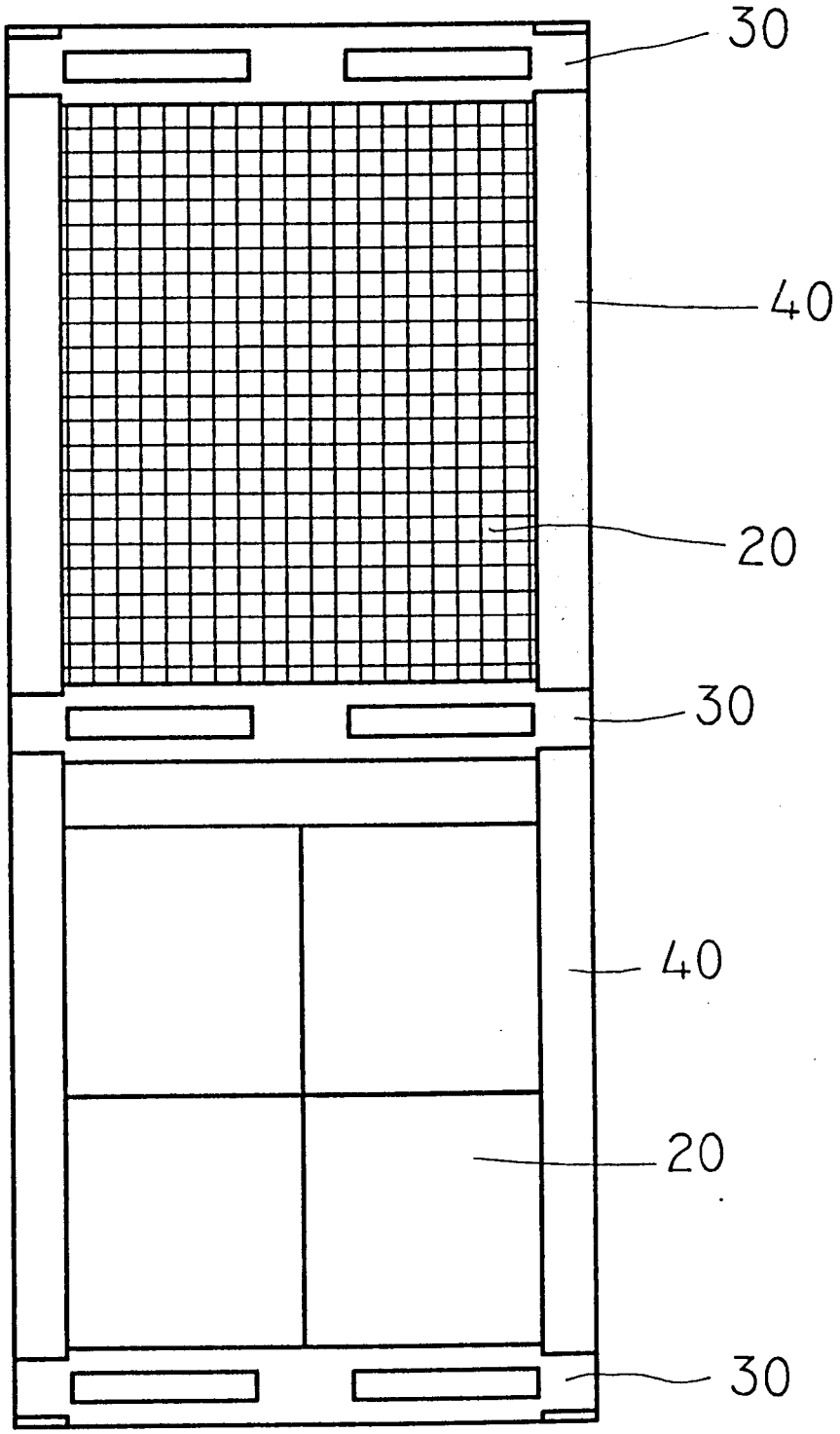
FIG. 4 shows the situation in which the inventories are stored by the trestle stage according to the present invention.

FIG.4 shows the situation in which the inventories are stored by the trestle stage according to the present utility. The first inventory 20 to be stored is placed on the plyboard 30, and moved with underlying plyboard 30 to a predetermined position by a forklift. To place a second inventory 20 on the first inventory, another plyboard is assembled with the underlying plyboard 30 by supporting beams 40 wherein the embedding pieces 41 are embedded into the through holes 32 and the embedding plates 42 are engaged with the embedding grooves 33 such that the plyboard 30 can be fixed by the supporting beams 40 firmly. Moreover, the connection between the plyboard 30 and the supporting beams 40 can be enhanced by a screw 43 joining the embedding plate 42 and the embedding groove 33. More specifically, each layer of plyboard 30 can be kept with constant separation by the supporting beams 40 therebetween, and the stored inventory 20 will not be subject to gravity force which is borne by the plyboard 30 and the supporting beams 40. Therefore, the trestle stage provided by the present invention can store the inventory 20 layer by layer while not squashing the inventory 20 to deformation.

Figure 5:
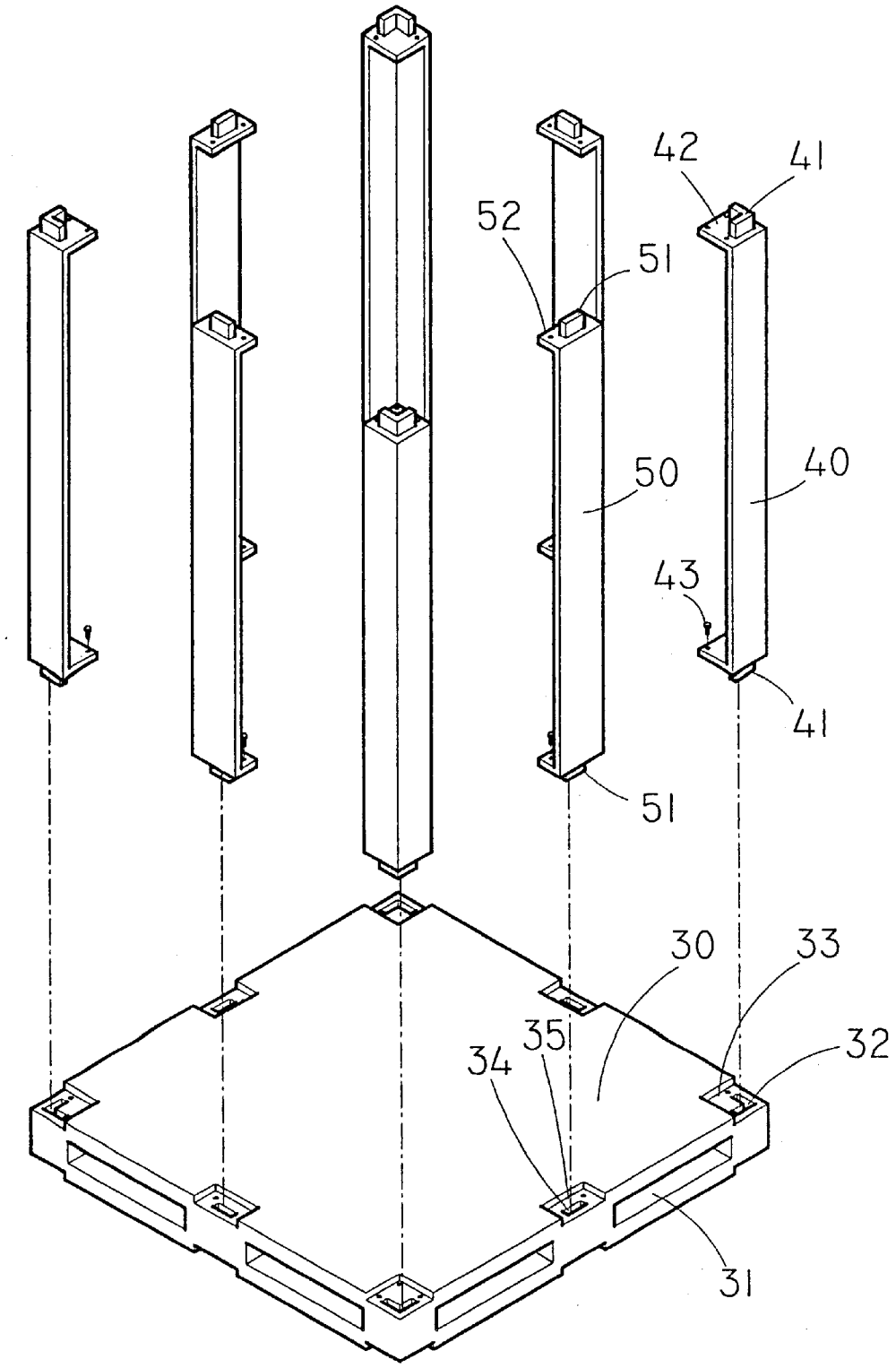
FIG. 5 shows an embodiment of the present invention.

As shown in FIG. 5, an auxiliary through hole 34 and auxiliary embedding groove 35 is provided between each two corner through holes 32 of the plyboard 30, and which, in cooperation with an auxiliary beam 50 having auxiliary embedding piece 51 and auxiliary embedding plate 52, can enhance the combination strength of the two plyboards to sustain more heavy inventory.

Moreover, the trestle stage can be arranged differently as used in different situation. For example, the plyboard 30 can be used without the supporting beams 40 when it is in single-layered application or placed on car.

Figure 6:
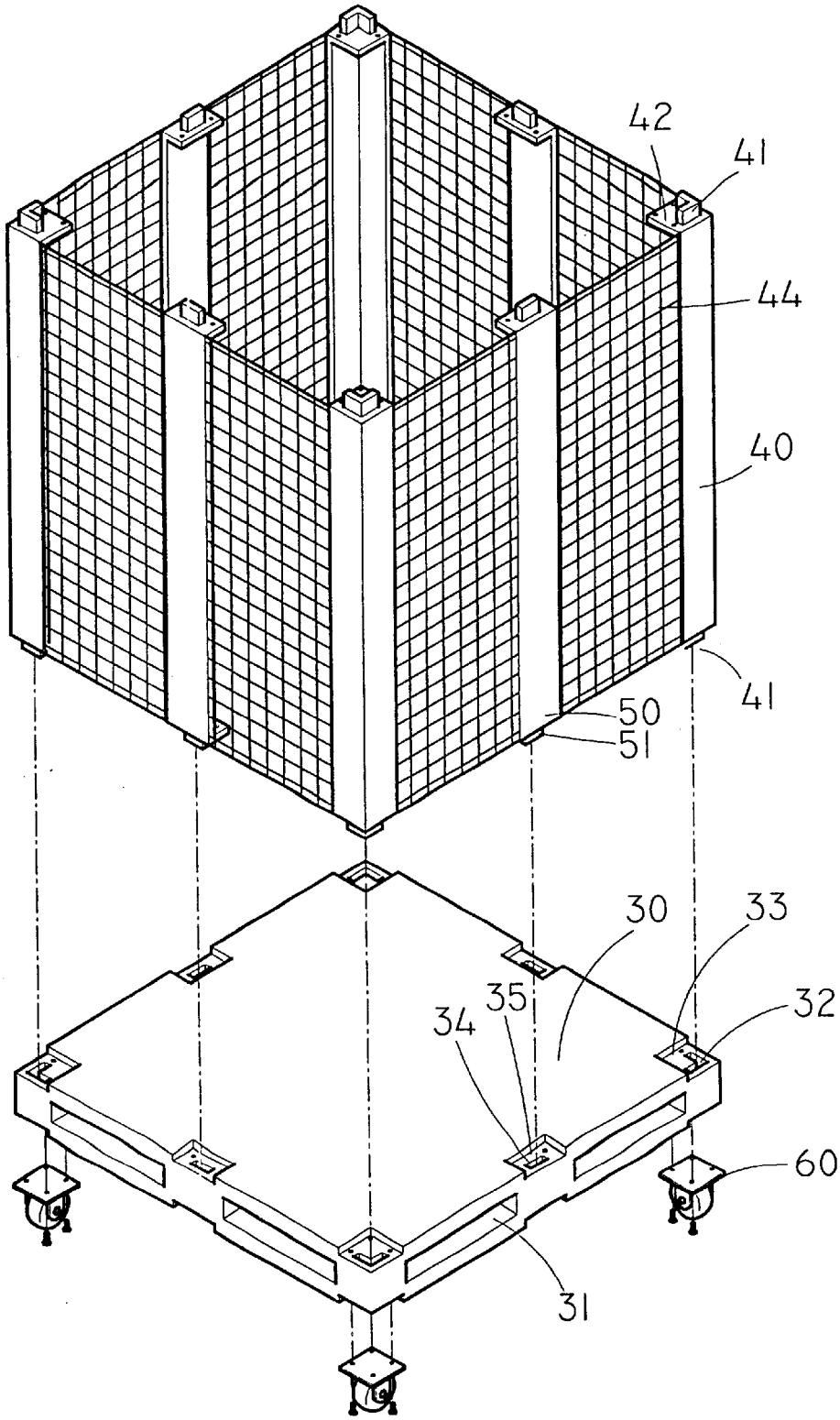
FIG. 6 shows another embodiment of the present invention.

As shown in FIG. 6, a mesh 44 can be arranged between the supporting beams 40 and 50 such that the trestle stage can function as a basket for storing article of smaller volume or in bulk. The embedding grooves 33 beneath the plyboard 30 can each be equipped with a wheel 60 such that the trestle stage can function as a truck.

While this invention has been described in connection with what is presently considered to be the most practical and preferred embodiment, it is to be understood that the invention is not limited to the disclosed embodiment and has various modifications. Therefore, the present invention is intended to cover various modifications and equivalent arrangements included within the spirit and scope of the appended claims.

I claim:

1. A trestle stage comprising:

(a) a rectangular-shaped plyboard having a top side and a bottom side, each corner of the top side and the bottom side being provided with a recessed embedding groove formed therein and a through hole formed in a bottom wall of the embedding groove, the through hole extending through the plyboard;

(b) a plurality of supporting beams, each beam having two opposite ends, each end including an embedding plate and an embedding piece extending outwardly of the embedding plate;

(c) the embedding piece and embedding plate of each end being respectively engagable within the through hole and the embedding groove of any corner to secure the end of the beam to the corner; and (d) wherein plural plyboards may be secured together in a spaced relationship by securing the opposite ends of four beams to opposing corners of adjacent plyboards, thereby permitting a load to be securely supported by each plyboard without defamation of the load.

2. The trestle stage of claim 1 further including at least one additional auxilliary embedding groove formed within each of the top and bottom sides of the plyboard and positioned between two lateral corners thereof, an auxilliary through hole formed in a bottom wall of each auxilliary embedding groove and extending through the plyboard, and an auxilliary beam including an auxilliary embedding plate and the auxilliary embedding piece extending outwardly of the plate for, respectively, engaging one of the auxilliary embedding grooves and the auxilliary through holes.

3. The trestle stage of claim 1 further including a mechanical fastener for securing each embedding plate to the bottom wall of a respective embedding groove.

4. The trestle stage of claim 1 further including a mesh extendable between adjacent beams secured to the plyboard to define a basket for containing a small load.

5. The trestle stage of claim 1 further including a wheel attached to at least one of the corners of the bottom side of the plyboard for permitting the trestle stage to be transported on a supporting surface.

* * * * *